US009403353B2

(12) United States Patent
Schaede et al.

(10) Patent No.: US 9,403,353 B2
(45) Date of Patent: Aug. 2, 2016

(54) INTAGLIO PRINTING PRESS WITH MOBILE CARRIAGE SUPPORTING INK-COLLECTING CYLINDER

(75) Inventors: Johannes Georg Schaede, Würzburg (DE); Volkmar Rolf Schwitzky, Würzburg (DE)

(73) Assignee: KBA-NotaSys SA, Lausanne (CH)

( * ) Notice: Subject to any disclaimer, the term of this patent is extended or adjusted under 35 U.S.C. 154(b) by 114 days.

(21) Appl. No.: 13/518,227

(22) PCT Filed: Dec. 20, 2010

(86) PCT No.: PCT/IB2010/055940

§ 371 (c)(1),
(2), (4) Date: Oct. 4, 2012

(87) PCT Pub. No.: WO2011/077348

PCT Pub. Date: Jun. 30, 2011

(65) Prior Publication Data

US 2013/0112095 A1 May 9, 2013

(30) Foreign Application Priority Data

Dec. 22, 2009 (EP) ..... 09180318

(51) Int. Cl.
*B41F 9/00* (2006.01)
*B41F 13/00* (2006.01)
(Continued)

(52) U.S. Cl.
CPC ..... *B41F 13/0024* (2013.01); *B41F 9/021* (2013.01); *B41F 31/004* (2013.01)

(58) Field of Classification Search
CPC ..... B41P 2213/11; B41P 2213/124; B41P 2213/126; B41P 2213/90; B41F 13/0024; B41F 9/021; B41F 31/004
USPC ..... 101/87, 150, 152, 170, 484, 485, 480, 101/479, 425, 423
See application file for complete search history.

(56) References Cited

U.S. PATENT DOCUMENTS 5,282,417 A 2/1994 Germann
5,899,145 A * 5/1999 Schaede ..... 101/152
(Continued)

FOREIGN PATENT DOCUMENTS

CH 685 380 6/1995
DE 100 27 022 1/2002
(Continued)

OTHER PUBLICATIONS

International Search Report for PCT/IB2010/055940, mailed Apr. 11, 2011.
(Continued)

*Primary Examiner* — Matthew G Marini
(74) *Attorney, Agent, or Firm* — Nixon & Vanderhye P.C.

(57) ABSTRACT

There is described an intaglio printing press comprising (i) a stationary machine frame (01) supporting an intaglio printing cylinder (07) and an impression cylinder (06) contacting the intaglio printing cylinder (07), (ii) an inking system (12, 13, 16) for inking the intaglio printing cylinder (07), which inking system (12, 13, 16) comprises an ink-collecting cylinder (12) de-signed to contact the intaglio printing cylinder (07) and at least one inking device (13, 16) for supplying ink to said ink-collecting cylinder (12), and (iii) at least a first mobile carriage (11) supporting the ink-collecting cylinder (12), which first mobile carriage (11) is adapted to be moved with respect to the stationary machine frame (01) between a working position where the ink-collecting cylinder (12) contacts the intaglio printing cylinder (07) and a retracted position where the ink-collecting cylinder (12) is retracted away from the intaglio printing cylinder (07). The intaglio printing press further comprises a correcting and adjusting system (80) for correcting and adjusting a rotational position of the ink-collecting cylinder (12) with respect to a rotational position of the intaglio printing cylinder (07) following maintenance operations to ensure proper circumferential register between the ink-collecting cylinder (12) and the intaglio printing cylinder (07) in the working position of the first mobile carriage (11).

56 Claims, 12 Drawing Sheets

(51) Int. Cl.
*B41F 9/02* (2006.01)
*B41F 31/00* (2006.01)

(56) References Cited

U.S. PATENT DOCUMENTS

| | | | | |
|---|---|---|---|---|
| 5,983,793 | A * | 11/1999 | Volz et al. | 101/216 |
| 6,272,987 | B1 | 8/2001 | Kamoda | |
| 7,011,020 | B2 | 3/2006 | Dunninger et al. | |
| 2001/0006027 | A1 | 7/2001 | Pfeiffer et al. | |
| 2004/0237816 | A1 | 12/2004 | Dunninger et al. | |
| 2005/0247219 | A1* | 11/2005 | Giancaterino et al. | 101/152 |
| 2006/0144265 | A1 | 7/2006 | Dunninger et al. | |
| 2007/0012207 | A1* | 1/2007 | Takenouchi et al. | 101/335 |
| 2007/0181016 | A1 | 8/2007 | Schaede | |
| 2010/0294149 | A1 | 11/2010 | Kusaka | |

FOREIGN PATENT DOCUMENTS

| | | |
|---|---|---|
| DE | 100 27 023 | 1/2002 |
| EP | 0 563 007 | 9/1993 |
| EP | 0 834 398 | 4/1998 |
| EP | 0 982 125 | 3/2000 |
| EP | 1 088 657 | 4/2001 |
| EP | 1 602 482 | 12/2005 |
| EP | 1 872 944 | 1/2008 |
| EP | 1 872 944 B1 | 8/2010 |
| EP | 2 253 468 | 11/2010 |
| JP | 2001-162771 | 6/2001 |
| WO | WO 03/047862 | 6/2003 |

OTHER PUBLICATIONS

Written Opinion of the International Searching Authority for PCT/IB2010/055940, filed Apr. 11, 2011.

* cited by examiner

INTAGLIO PRINTING PRESS WITH MOBILE CARRIAGE SUPPORTING INK-COLLECTING CYLINDER

This application is the U.S. national phase of International Application No. PCT/IB2010/055940, filed 20 Dec. 2010, which designated the U.S. and claims priority to EP Application No. 09180318.9, filed 22 Dec. 2009, the entire contents of each of which are hereby incorporated by reference.

PREAMBLE—TECHNICAL FIELD

The present invention generally relates to intaglio printing presses. More precisely, the present invention relates to an intaglio printing press comprising:

(i) a stationary machine frame supporting an intaglio printing cylinder and an impression cylinder contacting the intaglio printing cylinder;

(ii) an inking system for inking the intaglio printing cylinder, which inking system comprises an ink-collecting cylinder designed to contact the intaglio printing cylinder and at least one inking device for supplying ink to the ink-collecting cylinder; and (iii) at least a first mobile carriage supporting the ink-collecting cylinder, which first mobile carriage is adapted to be moved with respect to the stationary machine frame between a working position where the ink-collecting cylinder contacts the intaglio printing cylinder and a retracted position where the ink-collecting cylinder is retracted away from the intaglio printing cylinder.

The present invention further relates to a mobile carriage for an intaglio printing press, which mobile carriage supports an ink-collecting cylinder designed to contact an intaglio printing cylinder which is supported in a stationary machine frame of the intaglio printing machine.

BACKGROUND OF THE INVENTION

An intaglio printing press and mobile carriage of the above-mentioned types are disclosed in International Application No. WO 03/047862 A1 (which corresponds to U.S. Pat. No. 7,011,020 B2 in the name of the present Applicant) which intaglio printing press is reproduced in FIGS. 1A and 1B hereof. The intaglio printing press disclosed in this document comprises a first mobile carriage 11 supporting the ink-collecting cylinder 12 (also referred to as "Orlof cylinder"), as well as four colour-selector cylinders 13 (also referred to as "chablon cylinders") and a second mobile carriage 14 supporting four inking units 16 associated to the colour-selector cylinders 13. On the other hand, the plate cylinder 07 (or "intaglio printing cylinder") and the impression cylinder 06 (with its sheet grippers 08) are supported in a stationary machine frame 01 of the press. According to International Application No. WO 03/047862 A1, the two mobile carriages 11, 14 are suspended under suspension rails 04 below the endless chain gripper system 09 that takes the printed sheets away from the impression cylinder 06 so as to free the floor 02 onto which the printing press is installed from any supporting rails, the suspension rails 04 being supported at one end by the stationary machine frame 01 and at the other end by a supporting upright 03. The axes of rotation of the ink-collecting cylinder 12 and of the plate cylinder 07 are located in the same horizontal plane and movement of the mobile carriages 11, 14 takes place along this horizontal plane. As illustrated in FIG. 1A, thanks to this arrangement, a working space 17 big enough for a human operator can be formed between the first and second mobile carriages 11, 14 by moving the second mobile carriage 14 away from the first mobile carriage 11. As shown in FIG. 1B, a similarly big working space 18 can be formed between the first mobile carriage 11 and the stationary machine frame 01 by further moving the first mobile carriage 11 away from the stationary machine frame 01.

Swiss Patent No. CH 685 380 A5 and European Patent Application No. EP 0 563 007 A1 (which corresponds to U.S. Pat. No. 5,282,417) also disclose an intaglio printing press with first and second mobile carriages. In contrast to the previously-mentioned intaglio printing press, the first mobile carriage exclusively supports the ink-collecting cylinder, the colour-selector cylinders being located in the second mobile carriage together with the associated inking units. This is necessitated by the fact that, according to Swiss Patent No. CH 685 380 A5 and European Patent Application No. EP 0 563 007 A1, the ink-collecting cylinder is adapted to be removed from the press so as to convert the intaglio printing press from a press with indirect inking system to a press with direct inking system, and vice versa. The axes of rotation of the ink-collecting cylinder and of the intaglio printing cylinder are still located in the same horizontal plane and movement of the mobile carriages also takes place along this horizontal plane.

It has become apparent that the location of the ink-collecting cylinder in a mobile carriage could be problematic in that one loses the necessary circumferential register between the ink-collecting cylinder and intaglio printing cylinder as a result of rotating the ink-collecting cylinder during maintenance operations. Indeed, perfect circumferential register between the ink-collecting cylinder and the intaglio printing cylinder is critical in that this circumferential register determines the preciseness of the inking on the intaglio printing cylinder and therefore affects the printing quality.

In addition, as disclosed in International Application No. WO 03/047862 A1, Swiss Patent No. CH 685 380 A5, and European Patent Application No. EP 0 563 007 A1, it had previously been considered necessary to ensure that the axes of rotation the ink-collecting cylinder and of the intaglio printing cylinder should be aligned with the direction of displacement of the mobile carriage supporting the ink-collecting cylinder (i.e. in a horizontal plane) so as to avoid as much as possible occurrence of such circumferential register issues upon separation or joining of the ink-collecting cylinder and of the intaglio printing cylinder. Such horizontal arrangement of the ink-collecting cylinder and of the intaglio printing cylinder however has a negative effect on the machine footprint.

There is therefore a need for an improved intaglio printing press of the above-mentioned type where the ink-collecting cylinder is supported in a mobile carriage.

SUMMARY OF THE INVENTION

A general aim of the invention is therefore to provide an improved intaglio printing press of the above-mentioned type where the ink-collecting cylinder is supported in a mobile carriage.

A further aim of the invention is to provide such an intaglio printing press wherein proper circumferential register between the ink-collecting cylinder and intaglio printing cylinder can be ensured.

Yet another aim of the invention is to provide such an intaglio printing press where maintenance operations are facilitated.

These aims are achieved thanks to the intaglio printing press defined in the claims.

There is accordingly provided an intaglio printing press as mentioned in the preamble hereof further comprising a correcting and adjusting system for correcting and adjusting a rotational position of the ink-collecting cylinder with respect to a rotational position of the intaglio printing cylinder following maintenance operations to ensure proper circumferential register between the ink-collecting cylinder and the intaglio printing cylinder in the working position of the first mobile carriage.

There is further provided a mobile carriage for an intaglio printing press as mentioned in the preamble hereof further comprising a means for correcting and adjusting a rotational position of the ink-collecting cylinder with respect to a rotational position of the intaglio printing cylinder following maintenance operations to ensure proper circumferential register between the ink-collecting cylinder and the intaglio printing cylinder in a working position of the mobile carriage where the ink-collecting cylinder contacts the intaglio printing cylinder.

Further advantageous embodiments of the invention form the subject-matter of the dependent claims and are discussed below.

According to an additional aspect of the invention, the machine footprint of the intaglio printing press is reduced and space is optimised thanks to an advantageous arrangement and configuration of the impression cylinder, intaglio printing cylinder and ink-collecting cylinder.

BRIEF DESCRIPTION OF THE DRAWINGS

Features and advantages of the present invention will appear more clearly from reading the following detailed description of embodiments of the invention which are presented solely by way of non-restrictive examples and are illustrated by the attached drawings in which.

DETAILED DESCRIPTION OF EMBODIMENTS OF THE INVENTION

Within the scope of the present invention, the expression "intaglio printing cylinder" shall be understood to be designating a cylinder used for intaglio printing (especially for printing security documents such as banknotes) with at least one intaglio printing medium on its circumference. This encompasses either a cylinder with engraved intaglio patterns on its circumference or a plate cylinder carrying at least one intaglio printing plate on its circumference. In the following description, the intaglio printing cylinder is a plate cylinder carrying several intaglio printing plates on its circumference.

Similarly the expression "ink-collecting cylinder" shall be understood as being interchangeable with the expression "Orlof cylinder", which expression is typically used in the art of intaglio printing. The same applies to the expression "colour-selector cylinder" which shall be understood as being interchangeable with the expression "chablon cylinder", which latter expression is also used in the art of intaglio printing.

Figure 1A:
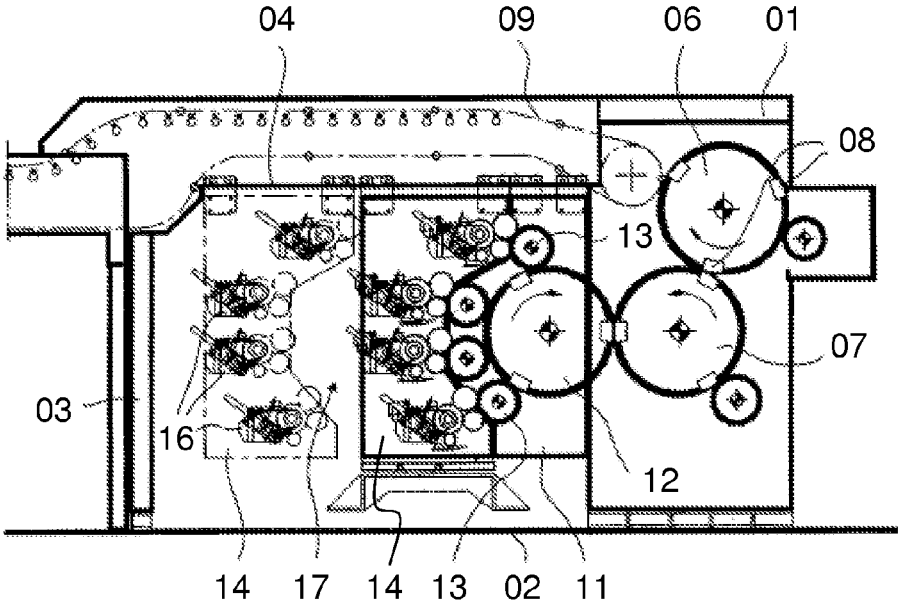
FIGS. 1A and 1B are side views of a known intaglio printing press.
Figure 1B:
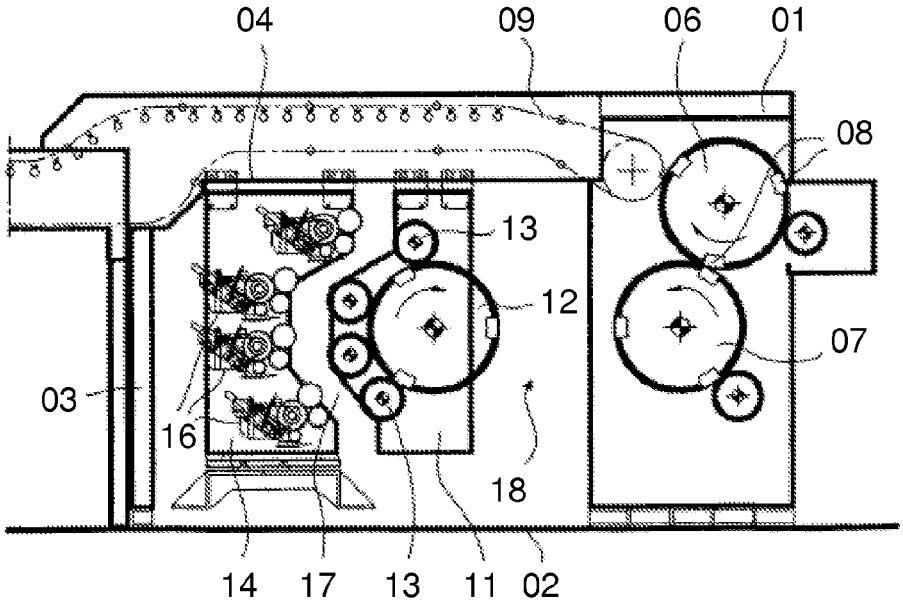
Figure 2A:
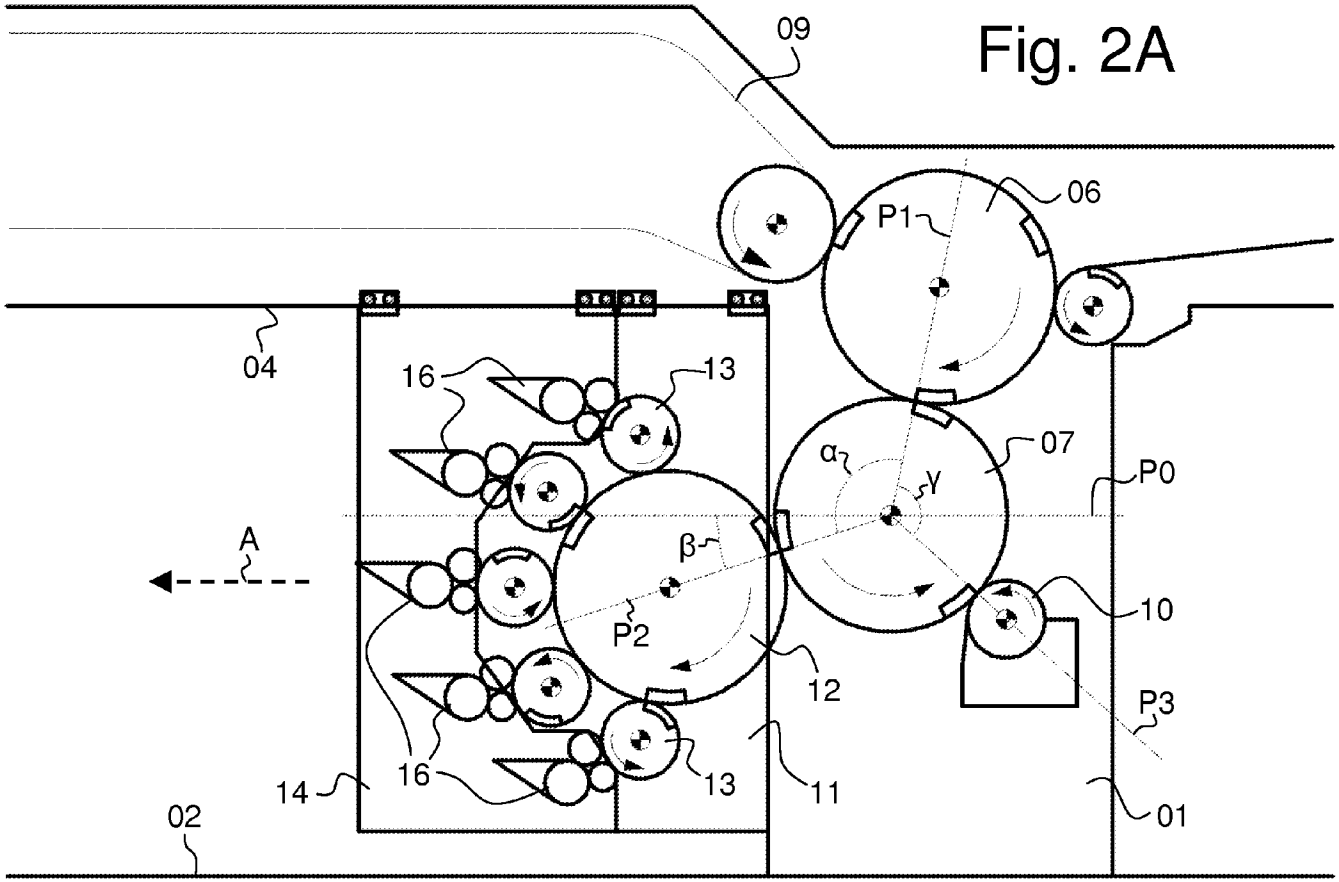
FIGS. 2A to 2F are side views of a preferred embodiment of an intaglio printing press according to the invention.

FIG. 2A illustrates a preferred embodiment of an intaglio printing press according to the invention. The various components of the press are shown here in their working positions, i.e. for carrying out printing operations. As shown, the intaglio printing press comprises a stationary machine frame 01 supporting an intaglio printing cylinder 07 and an impression cylinder 06 which contacts the intaglio printing cylinder 07. In this example, during printing operations, individual sheets are typically fed to the circumference of the impression cylinder 06 which then carries the sheets one after the other to the printing nip between the impression cylinder 06 and the intaglio printing cylinder 07 where the sheets are printed. Once printed, the sheets are then taken away from the circumference of the impression cylinder 06 by a suitable sheet delivery system which may typically comprise an endless chain gripper system 09 cooperating with the impression cylinder 06 downstream of the printing nip as schematically illustrated.

As illustrated, the stationary machine frame 01 further supports a wiping system for wiping the inked surface of the intaglio printing cylinder 07 prior to printing as is typical in the art. In the illustrated example, such wiping system comprises a wiping roller assembly 10 contacting the surface of the intaglio printing cylinder 07, which assembly includes a wiping roller that is caused to rotate in the same direction as the intaglio printing cylinder 07 (i.e. in the counter-clockwise direction in FIG. 2A). The direction of rotation of each cylinder or drum of the intaglio printing press is indicated in FIG. 2A by corresponding arrows.

The intaglio printing press is of the type comprising an inking system having an ink-collecting cylinder 12 (or "Orlof cylinder") which contacts the intaglio printing cylinder 07 and collects the inks of different colours provided by a plurality of associated inking devices 13, 16 before transferring the resulting multicolour pattern of inks to the circumference of the intaglio printing cylinder 07.

In this preferred example, the intaglio printing press comprises two mobile carriages 11, 14. The first mobile carriage 11 supports the ink-collecting cylinder 12 and a plurality of (at least four, preferably five as illustrated) colour-selector cylinders 13. The second mobile carriage 14 supports a corresponding number of (i.e. five in this example) inking units 16 each cooperating with a corresponding one of the colour-selector cylinders 13 that are supported in the first mobile carriage 11. Both mobile carriages can be moved horizontally and are suspended under suspension rails 04. In this way, both mobile carriages 11, 14 can be moved above the floor part 02 onto which the printing press is installed along a direction indicated by arrow A in FIG. 2A.

While the preferred embodiment includes two mobile carriages, it should be understood that the present invention is also applicable in the case where the printing press would only comprise one mobile carriage supporting the ink-collecting cylinder 12 and the associated inking devices 13, 16. More than two mobile carriages may also be envisaged.

FIGS. 2B to 2F illustrate various positions in which the mobile carriages 11, 14 may be brought during maintenance operations of the above-described intaglio printing press.

Figure 2B:
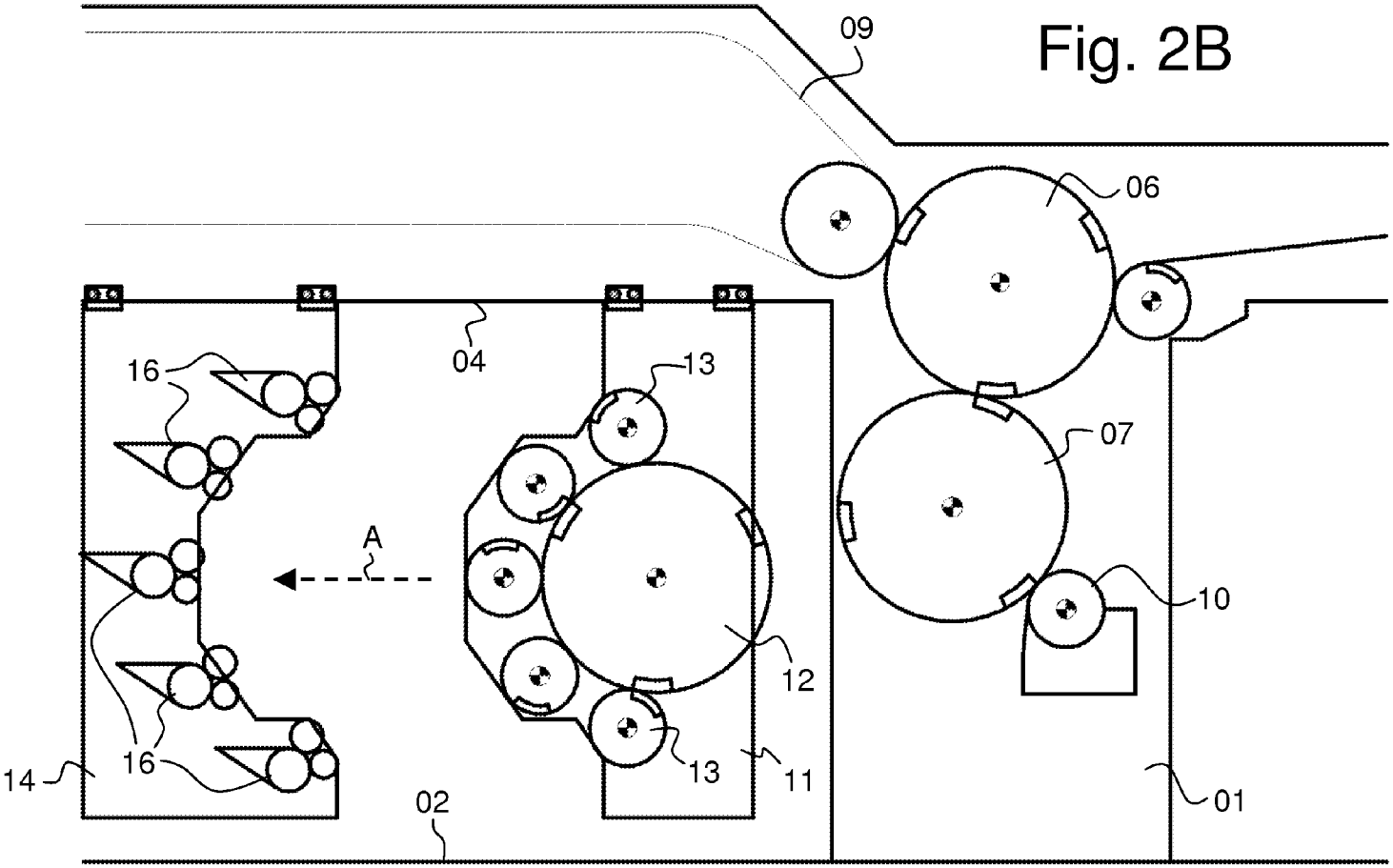

As mentioned, and illustrated in FIG. 2B, both mobile carriages 11, 14 may be retracted along a horizontal direction indicated by arrow A away from the stationary machine frame 01. The first and second mobile carriages 11, 14 can be moved independently of one another by means of corresponding carriage drives 40, 45 (not illustrated in FIGS. 2A to 2F—see FIGS. 3 to 5). If one only needs to carry out maintenance operations on the inking units 16 and the colour-selector cylinders 13, one may simply retract the second mobile carriage 14 away from the first mobile carriage 11 to create sufficient space for a human operator between the two mobile carriages 11, 14.

In the position illustrated in FIG. 2B, the second mobile carriage 14 has been moved to its retracted position, while the first mobile carriage 11 that supports the ink-collecting cylinder 12 and the colour-selector cylinders 13 is in the process of being retracted away from the stationary machine frame 01. In this position, the ink-collecting cylinder 12 does not contact the intaglio printing cylinder 07 anymore.

Figure 2C:
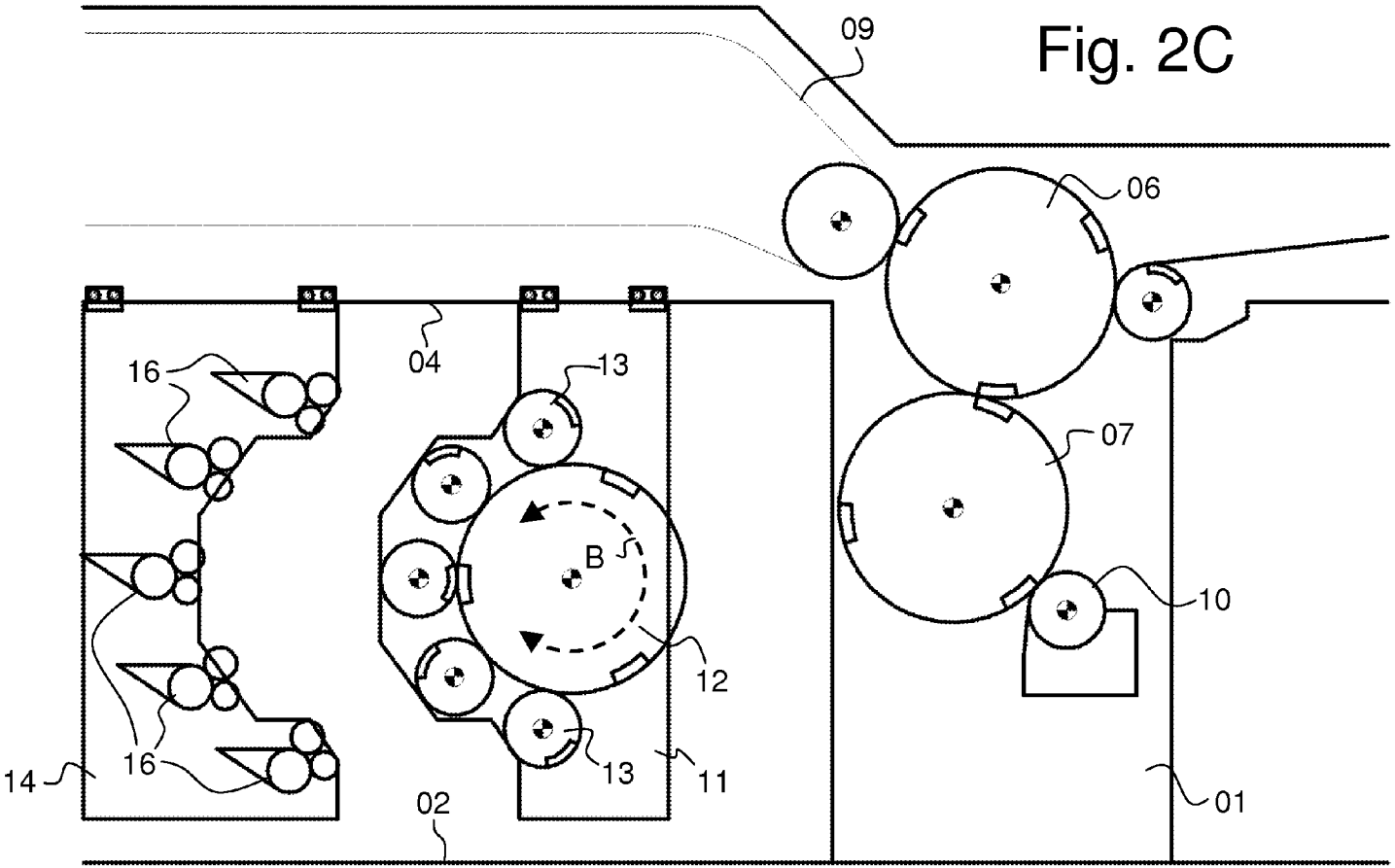

Once the first mobile carriage 11 is moved to its retracted position (which could be a position as illustrated in FIG. 2C or a position closer to—or even contacting—the second mobile carriage 14), the ink-collecting cylinder 12 may be rotated by the human operator (as illustrated by the arrow B in FIG. 2C).

Such rotation of the ink-collecting cylinder 12 would in particular be carried out in case one needs to replace the blankets that are typically mounted on the ink-collecting cylinder 12.

Figure 2D:
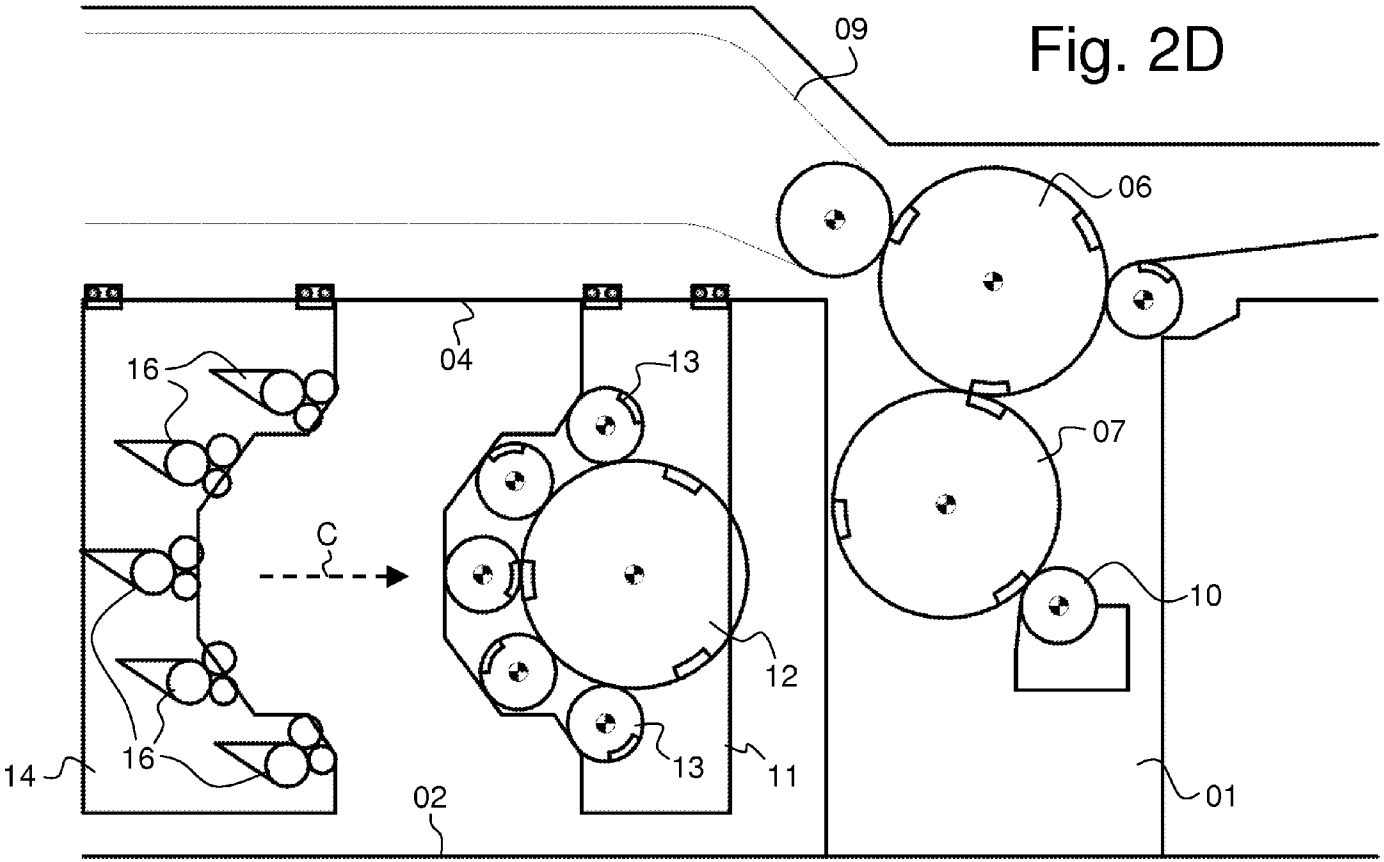

Once the maintenance operations have been carried out, the first mobile carriage 11 may be moved back towards the stationary machine frame 01 as illustrated by arrow C in FIG. 2D. In this Figure, it may be appreciated that the ink-collecting cylinder 12 is still in the same rotational position as in FIG. 2C, which rotational position is distinct from the one illustrated in FIGS. 2A and 2B. This rotational position of the ink-collecting cylinder 12 would be improper as it does not match with the position illustrated in FIGS. 2A and 2B that is necessary to properly cooperate with the intaglio printing cylinder 07.

Therefore, before coupling the first mobile carriage 11 with the stationary machine frame 01 (or upon coupling of the first mobile carriage 11 with the stationary machine frame 01), the rotational position of the ink-collecting cylinder 12 is corrected and adjusted with respect to the rotational position of the intaglio printing cylinder 07 to ensure proper circumferential register between the ink-collecting cylinder 12 and the intaglio printing cylinder 07. This is carried out by means of an adequate correcting and adjusting system that will be described hereafter, which system enables the ink-collecting cylinder 12 to be rotated to the appropriate position as illustrated by arrow D in FIG. 2E.

Figure 2E:
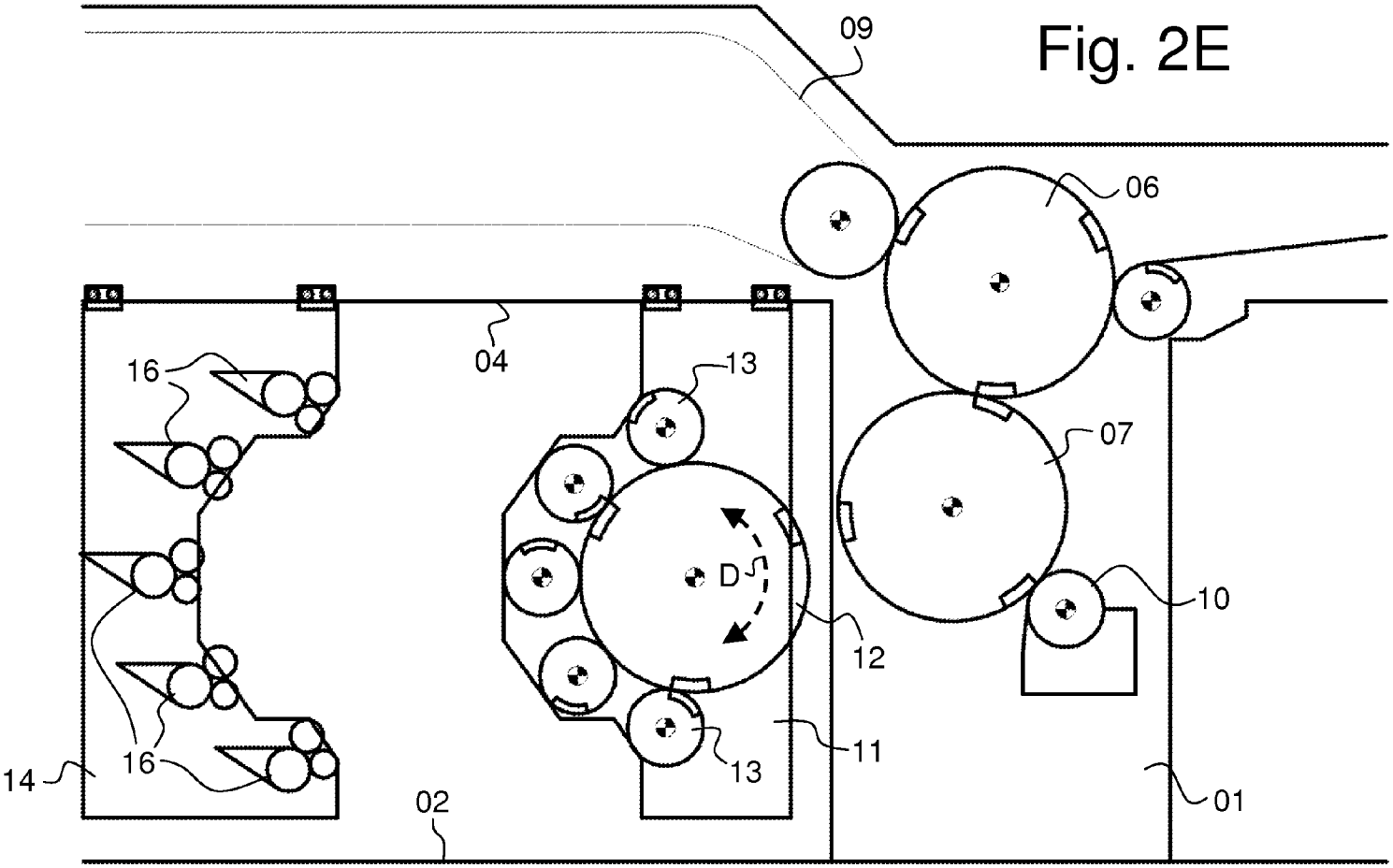
Figure 2F:
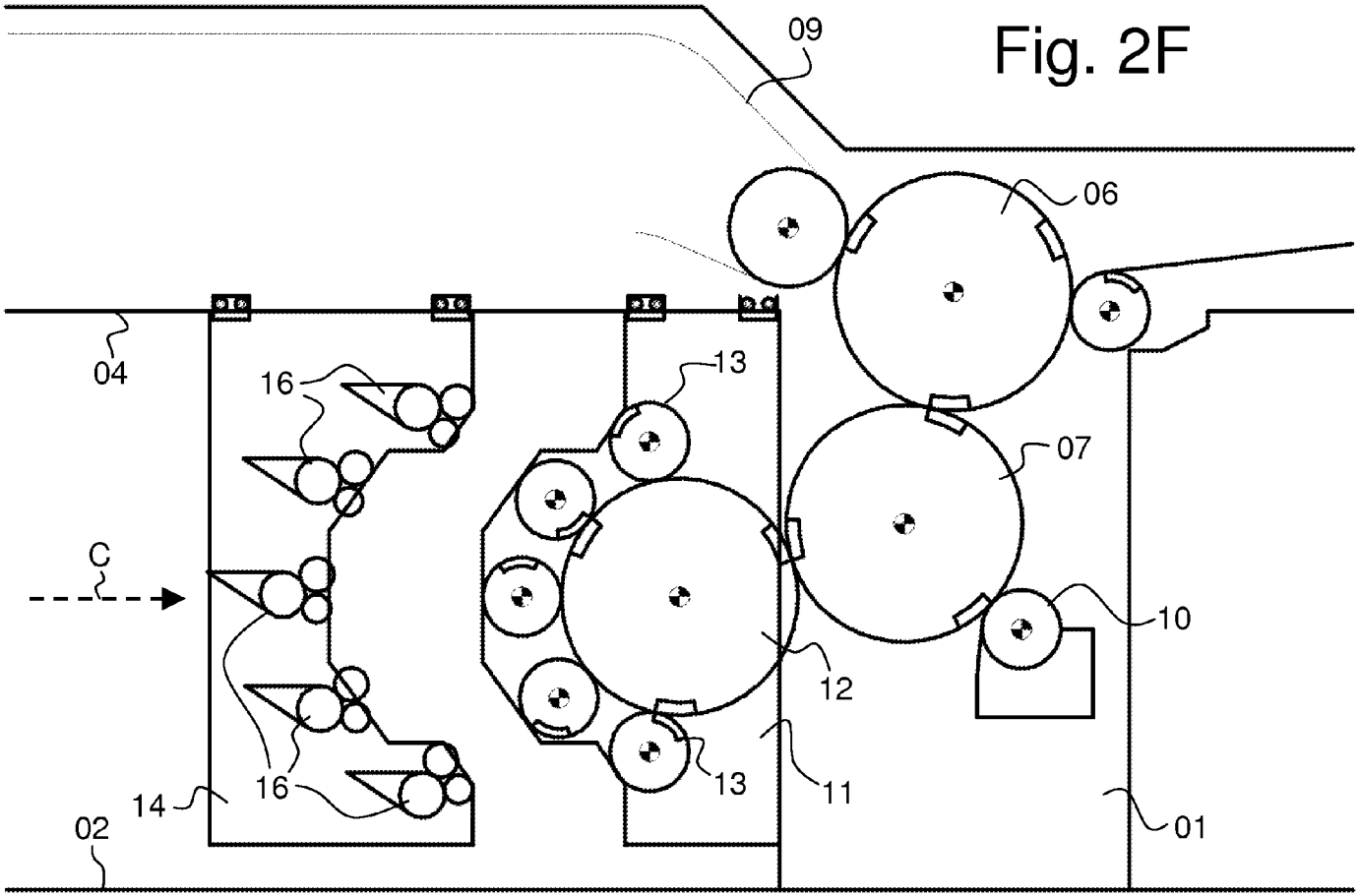

Once these corrections and adjustments have been carried out, the first mobile carriage 11 can be coupled to the machine frame 01 and interlocked therewith and the second mobile carriage 14 can be moved back towards the first mobile carriage 11 along arrow C as illustrated in FIG. 2F.

Turning back to FIG. 2A, one may further appreciate that the configuration of the intaglio printing press according to this preferred embodiment exhibits various additional features that are particularly advantageous.

Firstly, it may be appreciated that the axis of rotation of the ink-collecting cylinder 12 lies below a horizontal plane P0 intersecting the axis of rotation of the intaglio printing cylinder 07, which configuration allows to reduce the machine footprint as compared for instance to the known configuration disclosed in International Application No. WO 03/047862 A1. More precisely, the first mobile carriage 11 is moveable along the horizontal plane P0 and a plane P2 intersecting the axis of rotation of the ink-collecting cylinder 12 and the axis of rotation of the intaglio printing cylinder 07 forms, in the working position, an acute angle $\beta$ with respect to the horizontal plane P0.

In the illustrated example, the intaglio printing cylinder 07 is a three-segment plate cylinder carrying three intaglio printing plates. The corresponding cylinder pits on the intaglio printing cylinder (shown in FIG. 2A but not designated by any reference numeral) are accordingly distributed at angular intervals of 120°. Advantageously, the plane P2 intersecting the axis of rotation of the ink-collecting cylinder 12 and the axis of rotation of the intaglio printing cylinder 07 forms, in the working position, an obtuse angle $\alpha$ of 120° with respect to a plane P1 intersecting the axis of rotation of the impression cylinder 06 and the axis of rotation of the intaglio printing cylinder 07. One ensures in this way that the cylinder pits of the impression cylinder 06, of the intaglio printing cylinder 07 and of the ink-collecting cylinder 12 always meet at the same time, thereby preventing vibrations and shocks resulting from the meeting of the cylinder pits from having any influence on the printing and inking operations.

The wiping roller assembly 10 is preferably located in a similar way with respect to the intaglio printing cylinder 07, namely in such a way that a plane P3 intersecting the axis of rotation of the wiping roller assembly 10 and the axis of rotation of the intaglio printing cylinder 07 forms an obtuse angle $\gamma$ of 120° with respect to the plane P1 intersecting the axis of rotation of the impression cylinder 06 and the axis of rotation of the intaglio printing cylinder 07.

Preferably, in this configuration, the acute angle $\beta$ with respect to the horizontal plane P0 is selected to be lower or equal to 30°, even more preferably comprised between 10° and 25°.

One may further appreciate that the ink-collecting cylinder 12, the impression cylinder 06 and the intaglio printing cylinder 07 all have the same diameter (and are therefore triple-sized cylinders), meaning that the same sections of cylinders 06, 07, 12 always cooperate with one another.

One may also note that, in the preferred embodiment shown in FIGS. 2A to 2F, five colour-selector cylinders 13 are distributed around part of the circumference of the ink-collecting cylinder 12, one (namely the central one) being located in such a way that its axis of rotation lies substantially in the same horizontal plane as the axis of rotation of the ink-collecting cylinder 12. The remaining four colour-selector cylinders 13 are distributed substantially symmetrically around the ink-collecting cylinder 12 with respect to the horizontal plane intersecting the axis of rotation of the ink-collecting cylinder 12.

The above configuration ensures that space is used in an optimized way to integrate as many inking devices as possible and provide suitable access to every component of the printing press without compromising ease of maintenance and machine footprint. This configuration furthermore leads to an intaglio printing press having as much as possible a compact configuration.

Figure 3:
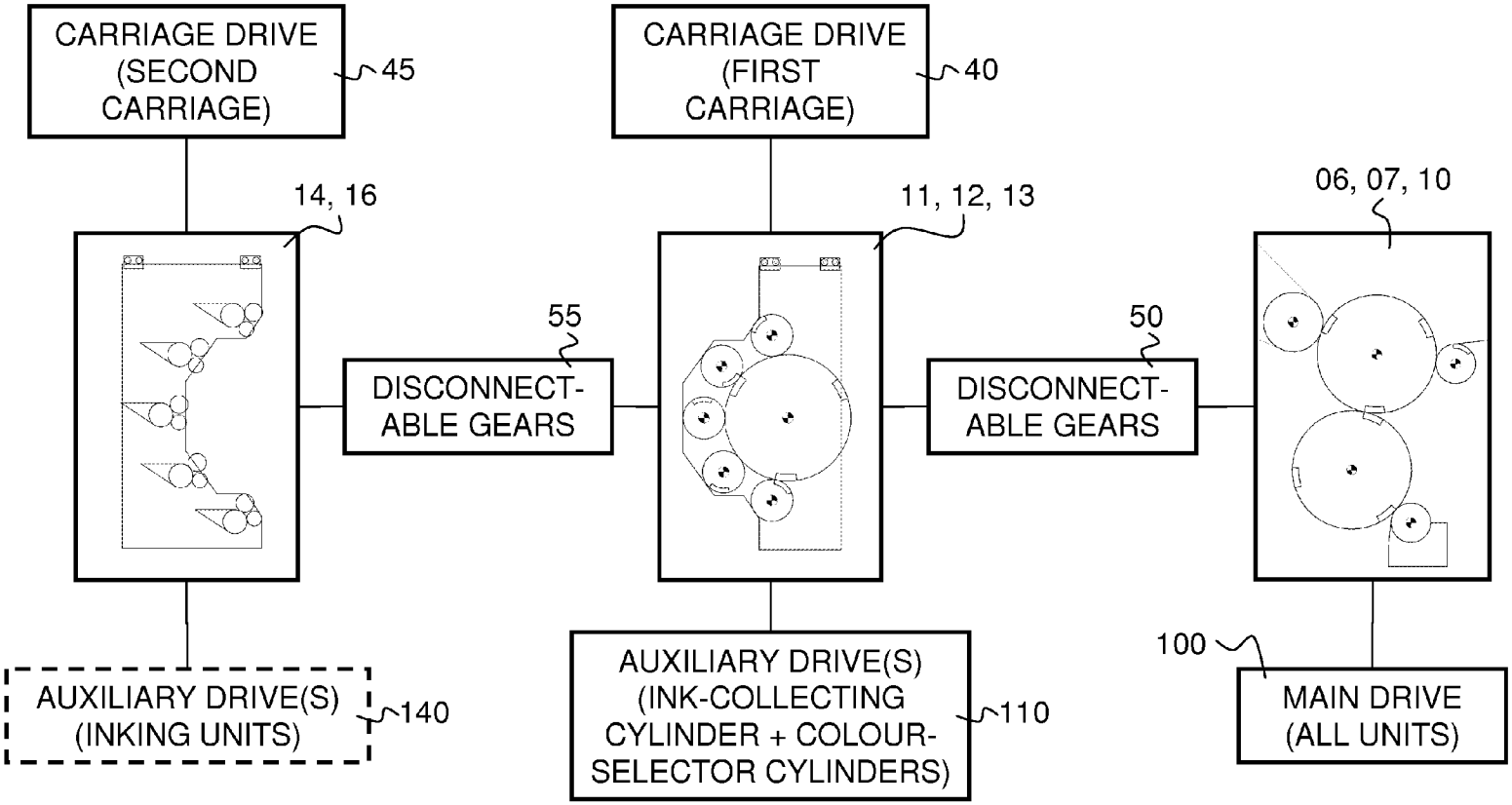
FIG. 3 is a block diagram schematically illustrating a first embodiment of a driving principle of the intaglio printing press of FIGS. 2A to 2F.

FIG. 3 is a block diagram schematically illustrating a first embodiment of a driving principle of the intaglio printing press of FIGS. 2A to 2F. In this example, the intaglio printing comprises a main drive 100 which, during printing operations, drives the intaglio printing cylinder 07, the impression cylinder 06 and the ink-collecting cylinder 12 into rotation via gears (as well as potentially other components, such as the wiping roller assembly 10 and the chain gripper system 09). Such gears include disconnectable gears 50 (schematically illustrated in FIG. 3) between the ink-collecting cylinder 12 and the intaglio printing cylinder 07 enabling the driving connection with the ink-collecting cylinder 12 to be interrupted when the mobile carriage 11 is retracted away from the stationary machine frame 01. In this example, since the gears 50 between the ink-collecting cylinder 12 and the intaglio printing cylinder 07 are disconnected upon displacement of the first mobile carriage 11 away from the stationary machine frame 01, a means is provided for correcting and adjusting a rotational position of the ink-collecting cylinder 12 with respect to a rotational position of the intaglio printing cylinder 07 to ensure proper circumferential register between the ink-collecting cylinder 12 and the intaglio printing cylinder 07.

In the example of FIG. 3, the means to correct and adjust the rotational position of the ink-collecting cylinder 12 takes the form of an auxiliary drive 110, such as a servo motor, for rotating the ink-collecting cylinder 12 when the mobile carriage 11 is uncoupled from the stationary machine frame 01.

Assuming that the colour-selector cylinders 13 are driven into rotation together with the ink-collecting cylinder 12, rotation of the colour-selector cylinder 13 during maintenance operations may be carried out using the same auxiliary drive 110. One may however envisage providing one or more additional auxiliary drive(s) to drive the colour-selector cylinders 13 into rotation during maintenance operations.

In the example of FIG. 3, disconnectable gears 55 are also provided between the first and second mobile carriages 11, 14, such gears 55 being disconnected upon displacement of the second mobile carriage 14 away from the first mobile carriage 11. Optionally, one or more additional auxiliary drive(s) 140 may be provided to drive the inking units 16 during maintenance operations when the second mobile carriage 14 is uncoupled from the first mobile carriage 11.

As the first and second mobile carriages 11, 14 are moved in an independent manner, two separate carriage drives 40, 45 are provided to drive the carriages 11, 14, respectively, along the suspension rails 04.

Figure 4:
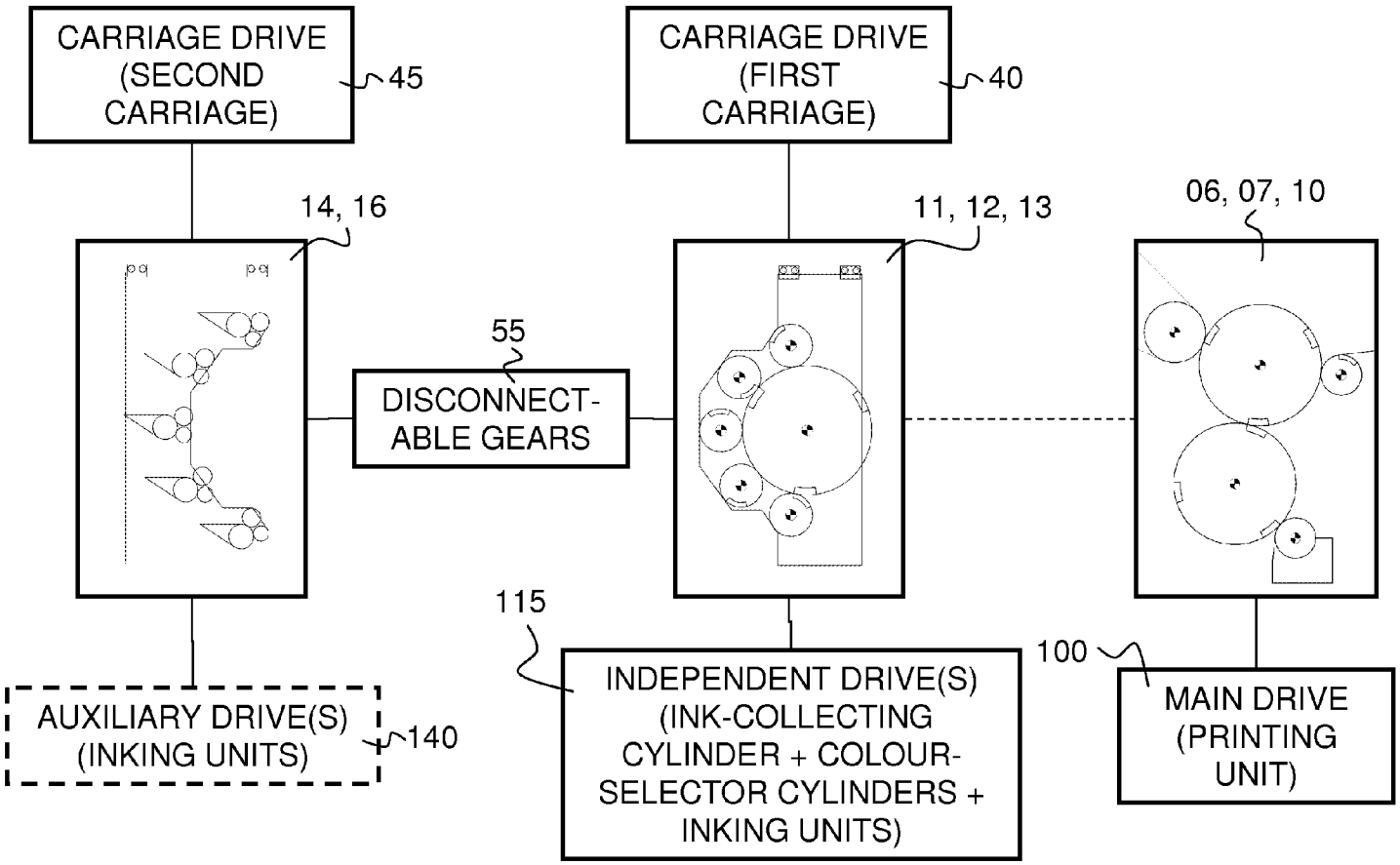
FIG. 4 is a block diagram schematically illustrating a second embodiment of a driving principle of the intaglio printing press of FIGS. 2A to 2F.

A possible variant of the driving principle of FIG. 3 is illustrated in FIG. 4. In this other example, rather than having the main drive 100 drive the ink-collecting cylinder 12 during printing operations, at least one independent drive 115 is provided to drive the ink-collecting cylinder 12 into rotation, independently of the intaglio printing cylinder 07 and impression cylinder 06. Such independent drive 115 is adapted to rotate the ink-collecting cylinder 12 at high speed and in phase synchronism with the intaglio printing cylinder 07 during printing operations. In this way, one may do without the disconnectable gears 50 of FIG. 3 and the said independent drive 115 can be used as the means to correct and adjust the rotational position of the ink-collecting cylinder 12 when the first mobile carriage 11 is uncoupled from the stationary machine frame 01.

Once again, assuming that the colour-selector cylinders 13 are driven into rotation together with the ink-collecting cylinder 12, rotation of the colour-selector cylinder 13 during maintenance operations may be carried out using the same independent drive 115. One may however envisage providing one or more additional independent drive(s) to drive the colour-selector cylinders 13 into rotation during maintenance operations.

In the example of FIG. 4, disconnectable gears 55 are still provided between the first and second mobile carriages 11 and 14 (as in FIG. 3). In this case, one or more auxiliary drive(s) 140 may optionally be provided to drive the inking units 16 during maintenance operations if necessary. It will however be understood that it is perfectly possible to do without any disconnectable gears at all and use one or more independent drive(s) to drive the inking units both during printing operations and maintenance operations.

Figure 5:
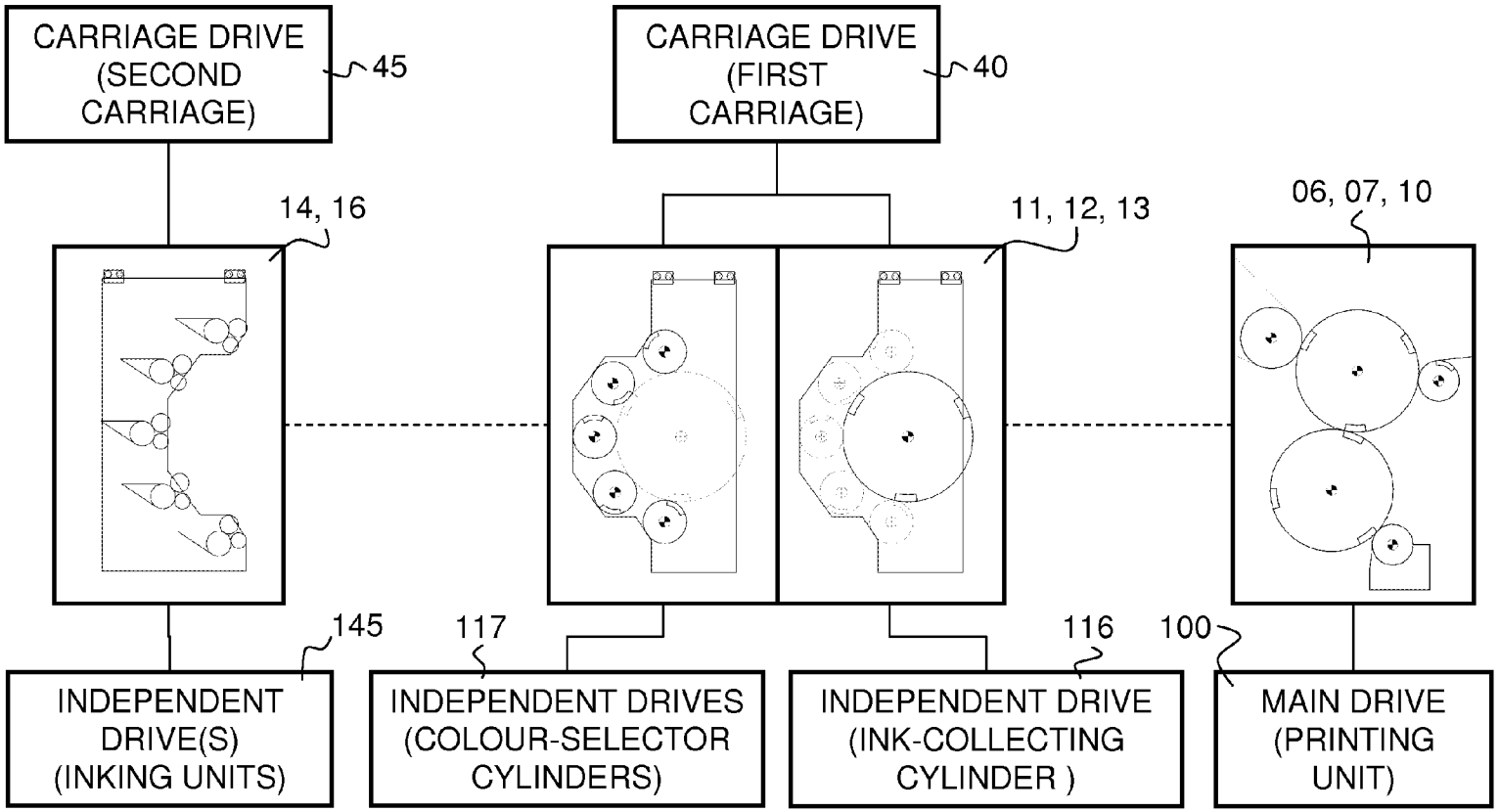
FIG. 5 is a block diagram schematically illustrating a third embodiment of a driving principle of the intaglio printing press of FIGS. 2A to 2F.

Yet another variant of the driving principles of FIGS. 3 and 4 is illustrated in FIG. 5. In this example, the main drive 100 is used to drive the components of the printing unit including the intaglio printing cylinder 07 and the impression cylinder 06 and various independent drives are used to drive the remaining components of the press, namely:

i. one independent drive 116 for driving the ink-collecting cylinder 12 into rotation;

ii. a plurality (e.g. five) of independent drives 117 for driving the colour-selector cylinders 13 located in the first mobile carriage 11; and iii. one or more independent drives 145 for driving the inking units 16 located in the second mobile carriage 14.

In this way, no disconnectable gear arrangement is necessary between the first mobile carriage 11 and the stationary machine frame 01 or between the second mobile carriage 14 and the first mobile carriage 11.

Various types of motors may be used as auxiliary drives or independent drives in the examples of FIGS. 3 to 5. So-called torque motors may especially be used as independent drive for the ink-collecting cylinder in the examples of FIGS. 4 and 5. A simple servo motor may suffice in the example of FIG. 3 where such drive is only necessary during maintenance operations to rotate the ink-collecting cylinder 12 at low speed.

Figure 6:
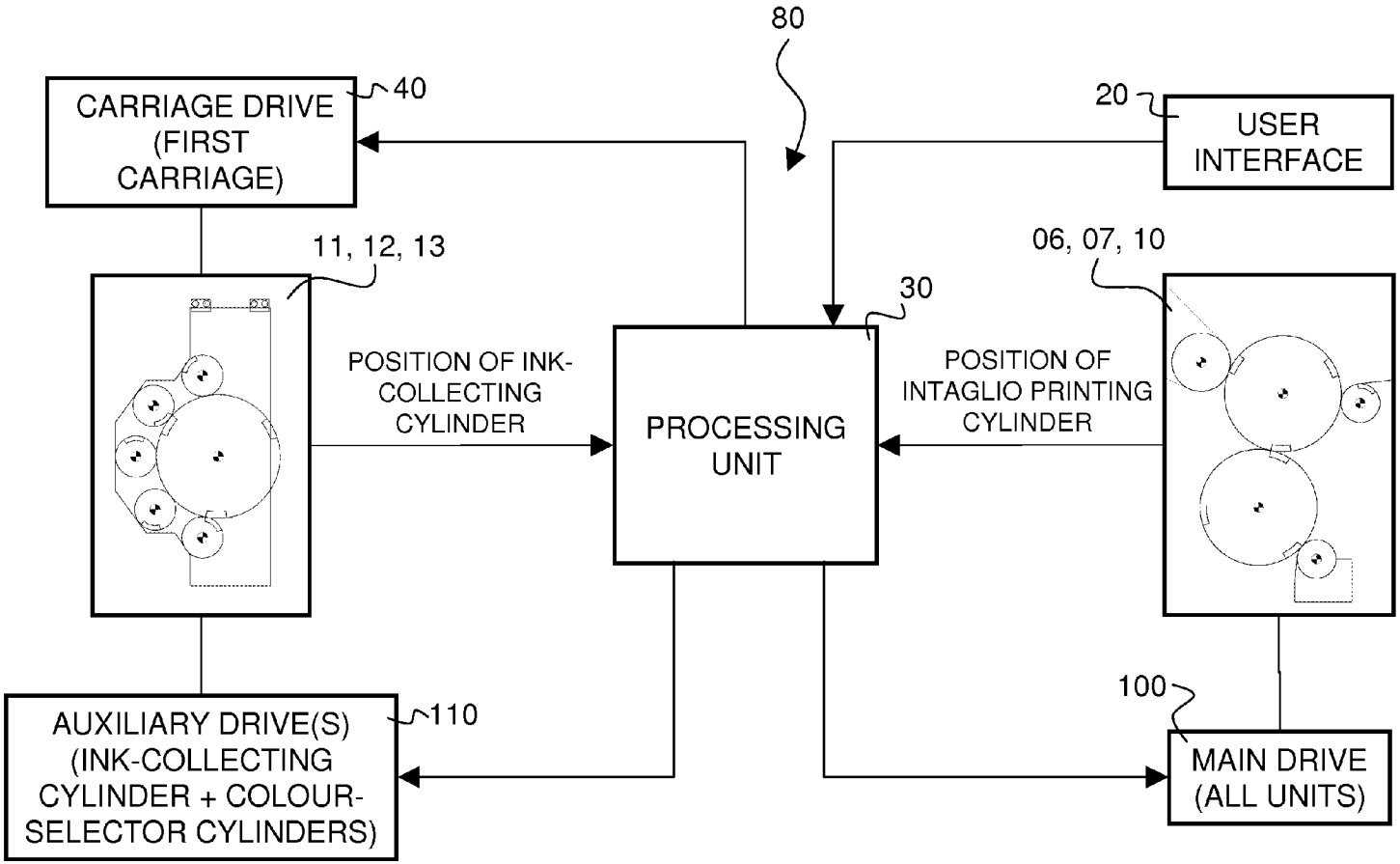
FIG. 6 is a block diagram schematically illustrating a first embodiment of a correcting and adjusting system for the intaglio printing press of FIGS. 2A to 2F.

A possible configuration of the correcting and adjusting system is illustrated in FIG. 6 where the said system is generally designated by reference numeral 80. The system shown in FIG. 6 is suitable for use in connection with the driving principle illustrated in FIG. 3. It essentially consists of a processing unit 30 that receives data regarding the rotational position of the ink-collecting cylinder 12 and of the intaglio printing cylinder 07. Such data may be provided by means of suitable rotational sensors, such as rotary encoders, measuring the rotational position of each cylinder 07, 12.

A suitable user interface 20 coupled to the processing unit 30 is provided to enable a human operator to control operations of the printing press, especially movement of the carriages 11, 14 towards and/or away from the stationary machine frame 01. The processing unit 30 is coupled to the carriage drive 40 and the auxiliary drive(s) 110 of the first carriage 11 and, whenever necessary or appropriate, to the main drive 100 as well. While this is not specifically illustrated in FIG. 6, the processing unit 30 is or may also be coupled to the carriage drive 45 and optional auxiliary drive(s) 140 of the second carriage 14 (not shown in FIG. 6).

A human operator may switch the printing press into a maintenance mode by using the user interface 20 and first causing the processing unit 30 to stop the main drive 100. Once the printing press is stopped, the processing unit 30 may read the current rotational position of the intaglio printing cylinder 07 and store it in a suitable memory (not illustrated) for the subsequent correction and adjustment process.

Then, the processing unit 30 may control the first carriage drive 40 (and the second carriage drive 45 not illustrated in FIG. 6) to cause retraction of the first mobile carriage 11 (and second mobile carriage 14 also not illustrated in FIG. 6) as illustrated in FIG. 2B.

The human operator may then further interact with the user interface 20 to cause the processing unit 30 to control the auxiliary drive(s) 110 and rotate the ink-collecting cylinder 12 during maintenance operations (for instance in order to exchange the blankets) as illustrated in FIG. 2C.

Once the maintenance operations have been carried out, the human operator may again interact with the user interface 20 to cause the first mobile carriage 11 to be moved back to its working position as illustrated in FIG. 2D. Before coupling of the first mobile carriage 11 with the stationary machine frame 01 (or upon coupling thereof), the processing unit 30 reads the current rotational position of the ink-collecting cylinder 12 and compares it with the rotational position of the intaglio printing cylinder 07. Whenever necessary, the processing unit 30 then issues suitable correction and adjustment signals to the auxiliary drive(s) 110 to correct and adjust the rotational position of the ink-collecting cylinder 12 until it matches the position required to ensure proper circumferential register between the ink-collecting cylinder 12 and the intaglio printing cylinder 07, as illustrated in FIG. 2E.

Figure 7:
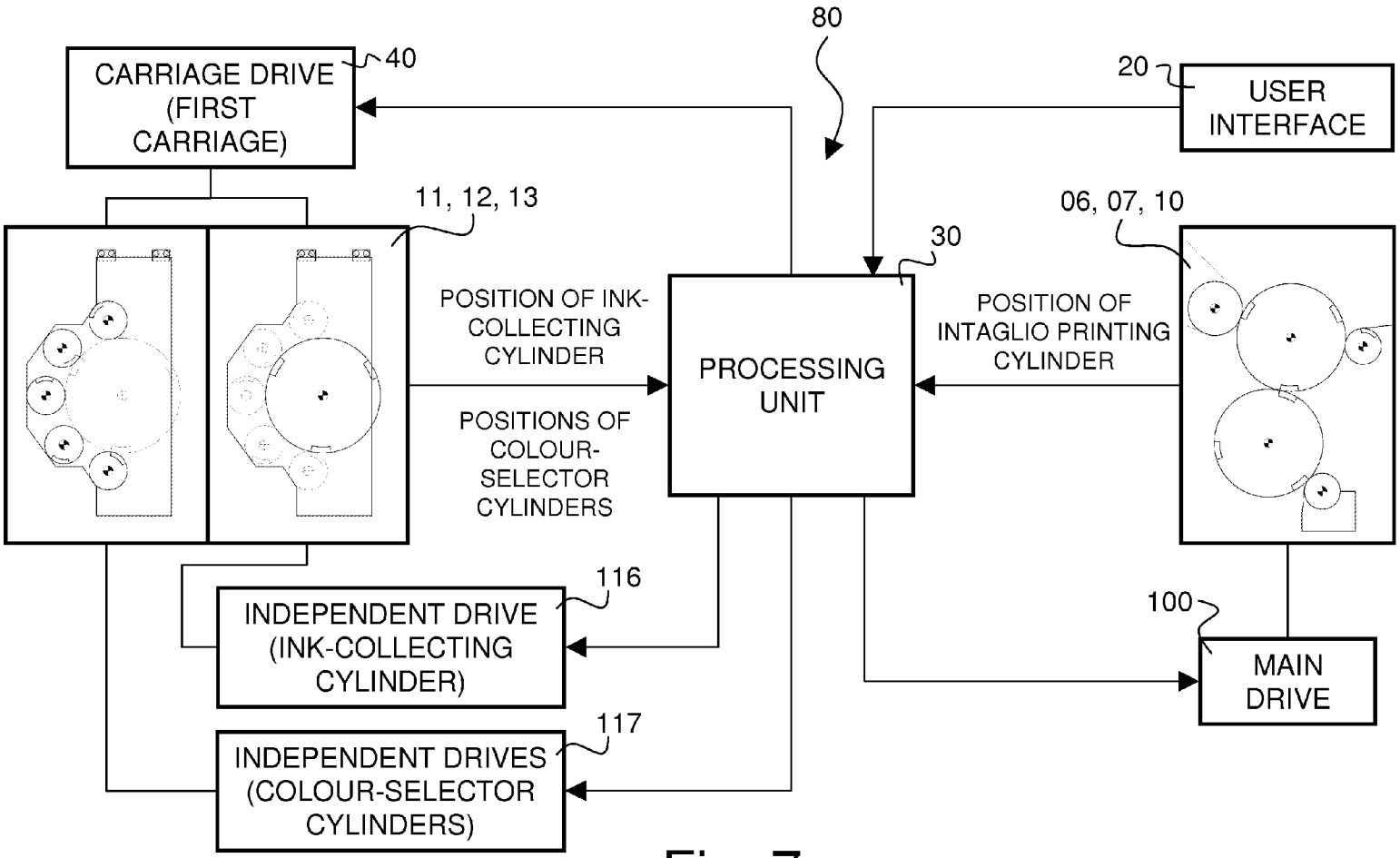
FIG. 7 is a block diagram schematically illustrating a second embodiment of a correcting and adjusting system for the intaglio printing press of FIGS. 2A to 2F.

A variant of the correcting and adjusting system 80 is illustrated in FIG. 7, which variant is suitable for use in connection with the driving principle illustrated in FIG. 5. The general configuration of the system shown in FIG. 7 is similar to that of FIG. 6, except that the processing unit 30 controls the rotational position of the ink-collecting cylinder 12 separately from that of the colour-selector cylinders 13, there being an independent drive 116 for driving the ink-collecting cylinder 12 and independent drives 117 for driving the colour-selector cylinders 13. In this example, the correcting and adjusting system 80 is used to control both the rotational position of the ink-collecting cylinder 12 and the rotational positions of the colour-selector cylinder 13 to ensure proper circumferential register thereof with respect to the intaglio printing cylinder 07.

In the above-described embodiments of the invention, the auxiliary drive 110 or independent drive 115 or 116 that is used to rotate the ink-collecting cylinder 12 can advantageously further act as a means to rotate the ink-collecting cylinder 12 during cleaning operations. Such cleaning operations could be carried out manually by an operator while the ink-collecting cylinder 12 is rotated or automatically. In particular, the intaglio printing press can further comprise an automatic washing device which can selectively be brought into contact with the ink-collecting cylinder 12 during cleaning operations so as to clean the circumference of the ink-collecting cylinder 12. Such washing device is not shown in the Figures as it is known as such in the art, for instance from German Patent Publications Nos. DE 100 27 022 A1 and DE 100 27 023 A1 (other washing devices being however possible).

An alternative to the use of an auxiliary drive to carry out the correction and adjustment procedure as discussed above may consist in providing the correcting and adjusting system with a sensor, such as a rotary encoder, for measuring the actual rotational position of the ink-collecting cylinder 12 and in adapting the correcting and adjusting system to cause the intaglio printing cylinder 07 to rotate (e.g. by operating the main drive 100) while the ink-collecting cylinder 12 is still retracted away from the intaglio printing cylinder 07 and properly position the intaglio printing cylinder 07 with respect to the ink-collecting cylinder 12 on the basis of the rotational position measured by the sensor before coupling the first mobile carriage 11 to the stationary frame 01. Therefore, in contrast to the previous embodiments, the intaglio printing cylinder 07 is rotated to achieve the proper circumferential register with respect to the ink-collecting cylinder 12 and the main drive 100 is exploited as a means to perform the necessary correction and adjustment.

Yet another alternative to the use of an auxiliary drive to carry out the correction and adjustment procedure as discussed above may consist in providing one or more reference markers on the ink-collecting cylinder 12 (each reference marker indicating a predefined rotational position of the ink-collecting cylinder 12) and in adapting the correcting and adjusting system to (i) temporarily couple the first mobile carriage 11 to the stationary frame 01, (ii) cause the ink-collecting cylinder 12 to rotate (e.g. by operating the main drive 100) to the rotational position indicated by the reference marker, (iii) decouple the first mobile carriage 11 from the stationary frame 01, and (iv) cause the intaglio printing cylinder 07 to rotate (e.g. by operating the main drive 100) while the ink-collecting cylinder 12 is retracted away from the intaglio printing cylinder 07 to a rotational position corresponding to the rotational position of the ink-collecting cylinder 12 defined by the reference marker before finally coupling the first mobile carriage 11 to the stationary frame 01. In this latter case, the main drive 100 is exploited to achieve the proper circumferential register between the intaglio printing cylinder 07 and the ink-collecting cylinder 12 by rotating both cylinders 07, 12.

Various modifications and/or improvements may be made to the above-described embodiments without departing from the scope of the invention as defined by the annexed claims. For instance, various adaptations to the configuration and operation of the correcting and adjusting system 80 may be made as long as the system is designed to perform its essential purpose, namely to correct and adjust a rotational position of the ink-collecting cylinder 12 with respect to a rotational position of the intaglio printing cylinder 07 to ensure proper circumferential register between the ink-collecting cylinder 12 and the intaglio printing cylinder 07. Furthermore, the actual configuration of the correcting and adjusting system 80 will depend on the actual driving principle being used, especially whether the ink-collecting cylinder is normally driven into rotation, during printing operations, by the main drive (thus necessitating an auxiliary drive for the maintenance operations as well as the correcting/adjusting operations) or whether the ink-collecting cylinder is driven into rotation, during printing operations, by an independent drive (in which case this same independent drive may be used during the maintenance operations as well as the correcting/adjusting operations).

Although the embodiment of the intaglio printing press which has been described in reference to the Figures comprises two mobile carriages, the concept of the invention remains valid for any other printing press configuration comprising at least one mobile carriage, as long as the ink-collecting cylinder is supported by the said at least one mobile carriage.

The intaglio printing press that has been discussed with reference to the Figures exhibits a cylinder configuration wherein the ink-collecting cylinder 12, the intaglio printing cylinder 07 and impression cylinder 06 are all triple-sized cylinder which form an angle of 120°. Any other cylinder configuration can however be envisaged, with cylinders of different sizes and/or different cylinder configurations and orientations.

LIST OF REFERENCES USED IN THE FIGURES AND SPECIFICATION

01 machine frame (stationary)
02 floor
03 upright
04 suspension rails
06 impression cylinder (three-segment cylinder)
07 intaglio printing cylinder/plate cylinder (three-segment cylinder)

08 sheet grippers
09 endless chain gripper system
10 wiping roller assembly
11 first mobile carriage
12 ink-collecting cylinder/Orlof cylinder (three-segment cylinder)
13 colour-selector cylinders/chablon cylinders (one-segment cylinder)
14 second mobile carriage
16 inking units
17 first working space (between first and second mobile carriages 11, 14)
18 second working space (between first mobile carriage 11 and machine frame 01)
20 user interface/central console
30 processing unit for circumferential register control and adjustment
40 carriage drive (first mobile carriage 11)
45 carriage drive (second mobile carriage 14)
50 disconnectable gears (between ink-collecting cylinder 12 and intaglio printing cylinder 07)
55 disconnectable gears (between ink-collecting cylinder 12, colour-selector cylinders 13 and inking units 16)
80 correcting and adjusting system
100 main drive
110 auxiliary drive(s) for ink-collecting cylinder 12 and colour-selector cylinders 13
115 independent drive(s) for ink-collecting cylinder 12 and colour-selector cylinders 13
116 independent drive for ink-collecting cylinder 12
117 independent drives for colour-selector cylinders 13
140 auxiliary drive(s) for inking units 16
145 independent drive(s) for inking units 16
P0 horizontal plane intersecting axis of intaglio printing cylinder 07
P1 plane intersecting axis of rotation of impression cylinder 06 and axis of rotation of intaglio printing cylinder 07
P2 plane intersecting axis of rotation of ink-collecting cylinder 12 and axis of rotation of intaglio printing cylinder 07
P3 plane intersecting axis of rotation of intaglio printing cylinder 07 and axis of rotation of wiping roller assembly 10
$\alpha$ obtuse angle between planes P1 and P2
$\beta$ acute angle between planes P0 and P2
$\gamma$ obtuse angle between planes P1 and P3
A displacement of mobile carriages 12, 14 from working position to retracted position (FIGS. 2A and 2B)
B rotation of ink-collecting cylinder 12 during maintenance operations (FIG. 2C)
C displacement of mobile carriages 12, 14 from retracted position to working position (FIGS. 2D and 2F)
D rotation of ink-collecting cylinder 12 during circumferential register correction and adjustment (FIG. 2E)

The invention claimed is:

1. An intaglio printing press comprising:
a stationary machine frame supporting an intaglio printing cylinder and an impression cylinder contacting the intaglio printing cylinder;
an inking system for inking the intaglio printing cylinder, which inking system comprises an ink-collecting cylinder designed to contact the intaglio printing cylinder and at least one inking device for supplying ink to the ink-collecting cylinder; and
at least a first mobile carriage supporting the ink-collecting cylinder, which first mobile carriage is adapted to be moved with respect to the stationary machine frame between a working position where the ink-collecting cylinder contacts the intaglio printing cylinder and a retracted position where the ink-collecting cylinder is retracted away from the intaglio printing cylinder,
wherein the intaglio printing press further comprises a correcting and adjusting system including a drive coupled to said ink-collecting cylinder and a processing unit coupled to the drive and controlling rotation of the ink-collecting cylinder during maintenance operations,
and wherein a rotational position of the ink-collecting cylinder with respect to a rotational position of the intaglio printing cylinder is correctable and adjustable following maintenance operations under the control of the processing unit to ensure proper circumferential register between the ink-collecting cylinder and the intaglio printing cylinder in the working position of the first mobile carriage.

2. The intaglio printing press as defined in claim 1, wherein the correcting and adjusting system is designed to correct and adjust the rotational position of the ink-collecting cylinder with respect to the rotational position of the intaglio printing cylinder upon or before coupling of the first mobile carriage to the stationary machine frame.

3. The intaglio printing press as defined in claim 1, further comprising a main drive coupled to the intaglio printing cylinder, the impression cylinder and the ink-collecting cylinder, the intaglio printing cylinder, impression cylinder and ink-collecting cylinder being driven into rotation during printing operations by said main drive via gears,
wherein the ink-collecting cylinder and the intaglio printing cylinder are coupled via disconnectable gears, which disconnectable gear are disconnected upon displacement of the first mobile carriage away from the stationary machine frame,
and wherein the drive of the correcting and adjusting system is an auxiliary drive coupled to the ink-collecting cylinder, the ink-collecting cylinder being driven into rotation during maintenance operations by the auxiliary drive to correct and adjust the rotational position of the ink-collecting cylinder with respect to the rotational position of the intaglio printing cylinder.

4. The intaglio printing press as defined in claim 3, wherein the auxiliary drive used for rotating the ink-collecting cylinder further acts as a means to rotate the ink-collecting cylinder during cleaning operations.

5. The intaglio printing press as defined in claim 4, further comprising an automatic washing device which can selectively be brought into contact with the ink-collecting cylinder during cleaning operations so as to clean the circumference of the ink-collecting cylinder.

6. The intaglio printing press as defined in claim 1, further comprising an independent drive coupled to the ink-collecting cylinder, the ink-collecting cylinder being driven into rotation during printing operations by the independent drive independently of the intaglio printing cylinder and impression cylinder,
wherein the drive of the correcting and adjusting system is the independent drive, the ink-collecting cylinder being driven into rotation during maintenance operations by the independent drive to correct and adjust the rotational position of the ink-collecting cylinder with respect to the rotational position of the intaglio printing cylinder.

7. The intaglio printing press as defined in claim 6, wherein the independent drive used for rotating the ink-collecting cylinder further acts as a means to rotate the ink-collecting cylinder during cleaning operations.

8. The intaglio printing press as defined in claim 7, further comprising an automatic washing device which can selectively be brought into contact with the ink-collecting cylinder during cleaning operations so as to clean the circumference of the ink-collecting cylinder.

9. The intaglio printing press as defined in claim 1, wherein the first mobile carriage is moveable along a horizontal plane and wherein a plane containing the axis of rotation of the ink-collecting cylinder and the axis of rotation of the intaglio printing cylinder forms in the working position an acute angle with respect to the horizontal plane.

10. The intaglio printing press as defined in claim 9, wherein the acute angle is lower or equal to 30°.

11. The intaglio printing press as defined in claim 10, wherein the acute angle is comprised between 10° and 25°.

12. The intaglio printing press as defined in claim 1, wherein the intaglio printing cylinder is a three-segment plate cylinder carrying three intaglio printing plates, and wherein a plane containing the axis of rotation of the ink-collecting cylinder and the axis of rotation of the intaglio printing cylinder forms in the working position an obtuse angle of 120° with respect to a plane containing the axis of rotation of the impression cylinder and the axis of rotation of the intaglio printing cylinder.

13. The intaglio printing press as defined in claim 12, further comprising a wiping system for wiping the inked surface of the intaglio printing cylinder, wherein the wiping system comprises a wiping roller assembly contacting the surface of the intaglio printing cylinder, and wherein a plane containing the axis of rotation of the wiping roller assembly and the axis of rotation of the intaglio printing cylinder forms an obtuse angle of 120° with respect to the plane containing the axis of rotation of the impression cylinder and the axis of rotation of the intaglio printing cylinder.

14. The intaglio printing press as defined in claim 12, wherein the axis of rotation of the ink-collecting cylinder lies below a horizontal plane containing the axis of rotation of the intaglio printing cylinder.

15. The intaglio printing press as defined in claim 14, wherein the plane containing the axis of rotation of the ink-collecting cylinder and the axis of rotation of the intaglio printing cylinder forms in the working position an acute angle with respect to the horizontal plane.

16. The intaglio printing press as defined in claim 15, wherein the acute angle is lower or equal to 30°.

17. The intaglio printing press as defined in claim 16, wherein the acute angle is comprised between 10° and 25°.

18. The intaglio printing press as defined in claim 1, wherein the ink-collecting cylinder has the same diameter as the intaglio printing cylinder.

19. The intaglio printing press as defined in claim 1, wherein the impression cylinder has the same diameter as the intaglio printing cylinder.

20. The intaglio printing press as defined in claim 1, wherein the ink-collecting cylinder is a three-segment ink-collecting cylinder and wherein the inking system comprises at least four inking devices distributed about a portion of the circumference of the ink-collecting cylinder.

21. The intaglio printing press as defined in claim 20, wherein the inking system comprises five inking devices distributed about a portion of the circumference of the ink-collecting cylinder.

22. The intaglio printing press as defined in claim 1, wherein the intaglio printing press further comprises a second mobile carriage supporting at least part of the at least one inking device, which second mobile carriage is adapted to move with respect to the first mobile carriage between a working position where the second mobile carriage contacts the first mobile carriage and a retracted position where the second mobile carriage is retracted away from the first mobile carriage.

23. The intaglio printing press as defined in claim 1, wherein the at least one inking device comprises an inking unit and a colour-selector cylinder which is inked by the inking unit and contacts a portion of the circumference of the ink-collecting cylinder, and wherein the first mobile carriage also supports the colour-selector cylinder of the at least one inking device.

24. The intaglio printing press as defined in claim 1, wherein the inking system comprises one or more inking devices distributed about a portion of the circumference of the ink-collecting cylinder, each inking device comprising an inking unit and a colour-selector cylinder which is inked by the inking unit and contacts a portion of the circumference of the ink-collecting cylinder, and wherein each colour-selector cylinder can be driven into rotation during maintenance operations by the drive of the correcting and adjusting system under the control of the processing unit.

25. The intaglio printing press as defined in claim 1, wherein the inking system comprises one or more inking devices distributed about a portion of the circumference of the ink-collecting cylinder, each inking device comprising an inking unit and a colour-selector cylinder which is inked by the inking unit and contacts a portion of the circumference of the ink-collecting cylinder, wherein the intaglio printing press comprises an additional drive coupled to each colour-selector cylinder and to the processing unit, and wherein each colour-selector cylinder can be driven into rotation during maintenance operations by the additional drive under the control of the processing unit.

26. An intaglio printing press comprising:

a stationary machine frame supporting an intaglio printing cylinder and an impression cylinder contacting the intaglio printing cylinder;

an inking system for inking the intaglio printing cylinder, which inking system comprises an ink-collecting cylinder designed to contact the intaglio printing cylinder and at least one inking device for supplying ink to the ink-collecting cylinder; and at least a first mobile carriage supporting the ink-collecting cylinder, which first mobile carriage is adapted to be moved with respect to the stationary machine frame between a working position where the ink-collecting cylinder contacts the intaglio printing cylinder and a retracted position where the ink-collecting cylinder is retracted away from the intaglio printing cylinder, wherein the intaglio printing press further comprises a correcting and adjusting system for correcting and adjusting a rotational position of the ink-collecting cylinder with respect to a rotational position of the intaglio printing cylinder following maintenance operations to ensure proper circumferential register between the ink-collecting cylinder and the intaglio printing cylinder in the working position of the first mobile carriage, wherein the correcting and adjusting system comprises a sensor for measuring the actual rotational position of the ink-collecting cylinder, and wherein the correcting and adjusting system is adapted to cause the intaglio printing cylinder to rotate while the ink-collecting cylinder is still retracted away from the intaglio printing cylinder and to properly position the intaglio printing cylinder with respect to the ink-collecting cylinder on the basis of the rotational position measured by the sensor before coupling the first mobile carriage to the stationary frame.

27. The intaglio printing press as defined in claim 26, wherein the sensor is a rotary encoder.

28. The intaglio printing press as defined in claim 26, wherein the first mobile carriage is moveable along a horizontal plane and wherein a plane containing the axis of rotation of the ink-collecting cylinder and the axis of rotation of the intaglio printing cylinder forms in the working position an acute angle with respect to the horizontal plane.

29. The intaglio printing press as defined in claim 28, wherein the acute angle is lower or equal to 30°.

30. The intaglio printing press as defined in claim 29, wherein the acute angle is comprised between 10° and 25°.

31. The intaglio printing press as defined in claim 26, wherein the intaglio printing cylinder is a three-segment plate cylinder carrying three intaglio printing plates, and wherein a plane containing the axis of rotation of the ink-collecting cylinder and the axis of rotation of the intaglio printing cylinder forms in the working position an obtuse angle of 120° with respect to a plane containing the axis of rotation of the impression cylinder and the axis of rotation of the intaglio printing cylinder.

32. The intaglio printing press as defined in claim 31, further comprising a wiping system for wiping the inked surface of the intaglio printing cylinder, wherein the wiping system comprises a wiping roller assembly contacting the surface of the intaglio printing cylinder, and wherein a plane containing the axis of rotation of the wiping roller assembly and the axis of rotation of the intaglio printing cylinder forms an obtuse angle of 120° with respect to the plane containing the axis of rotation of the impression cylinder and the axis of rotation of the intaglio printing cylinder.

33. The intaglio printing press as defined in claim 31, wherein the axis of rotation of the ink-collecting cylinder lies below a horizontal plane containing the axis of rotation of the intaglio printing cylinder.

34. The intaglio printing press as defined in claim 33, wherein the plane containing the axis of rotation of the ink-collecting cylinder and the axis of rotation of the intaglio printing cylinder forms in the working position an acute angle with respect to the horizontal plane.

35. The intaglio printing press as defined in claim 34, wherein the acute angle is lower or equal to 30°.

36. The intaglio printing press as defined in claim 35, wherein the acute angle is comprised between 10° and 25°.

37. The intaglio printing press as defined in claim 26, wherein the ink-collecting cylinder has the same diameter as the intaglio printing cylinder.

38. The intaglio printing press as defined in claim 26, wherein the impression cylinder has the same diameter as the intaglio printing cylinder.

39. The intaglio printing press as defined in claim 26, wherein the ink-collecting cylinder is a three-segment ink-collecting cylinder and wherein the inking system comprises at least four inking devices distributed about a portion of the circumference of the ink-collecting cylinder.

40. The intaglio printing press as defined in claim 26, wherein the intaglio printing press further comprises a second mobile carriage supporting at least part of the at least one inking device, which second mobile carriage is adapted to move with respect to the first mobile carriage between a working position where the second mobile carriage contacts the first mobile carriage and a retracted position where the second mobile carriage is retracted away from the first mobile carriage.

41. The intaglio printing press as defined in claim 26, wherein the at least one inking device comprises an inking unit and a colour-selector cylinder which is inked by the inking unit and contacts a portion of the circumference of the ink-collecting cylinder, and wherein the first mobile carriage also supports the colour-selector cylinder of the at least one inking device.

42. An intaglio printing press comprising:

a stationary machine frame supporting an intaglio printing cylinder and an impression cylinder contacting the intaglio printing cylinder;

an inking system for inking the intaglio printing cylinder, which inking system comprises an ink-collecting cylinder designed to contact the intaglio printing cylinder and at least one inking device for supplying ink to the ink-collecting cylinder; and at least a first mobile carriage supporting the ink-collecting cylinder, which first mobile carriage is adapted to be moved with respect to the stationary machine frame between a working position where the ink-collecting cylinder contacts the intaglio printing cylinder and a retracted position where the ink-collecting cylinder is retracted away from the intaglio printing cylinder, wherein the intaglio printing press further comprises a correcting and adjusting system for correcting and adjusting a rotational position of the ink-collecting cylinder with respect to a rotational position of the intaglio printing cylinder following maintenance operations to ensure proper circumferential register between the ink-collecting cylinder and the intaglio printing cylinder in the working position of the first mobile carriage, wherein one or more reference markers is/are provided on the ink-collecting cylinder, each reference marker indicating a predefined rotational position of the ink-collecting cylinder, and wherein the correcting and adjusting system is adapted to:

(i) temporarily couple the first mobile carriage to the stationary frame;

(ii) cause the ink-collecting cylinder to rotate to the rotational position indicated by a reference marker;

(iii) temporarily decouple the first mobile carriage from the stationary frame; and (iv) cause the intaglio printing cylinder to rotate while the ink-collecting cylinder is retracted away from the intaglio printing cylinder to a rotational position corresponding to the rotational position of the ink-collecting cylinder defined by the reference marker before finally coupling the first mobile carriage to the stationary frame.

43. The intaglio printing press as defined in claim 42, wherein the first mobile carriage is moveable along a horizontal plane and wherein a plane containing the axis of rotation of the ink-collecting cylinder and the axis of rotation of the intaglio printing cylinder forms in the working position an acute angle with respect to the horizontal plane.

44. The intaglio printing press as defined in claim 43, wherein the acute angle is lower or equal to 30°.

45. The intaglio printing press as defined in claim 44, wherein the acute angle is comprised between 10° and 25°.

46. The intaglio printing press as defined in claim 42, wherein the intaglio printing cylinder is a three-segment plate cylinder carrying three intaglio printing plates, and wherein a plane containing the axis of rotation of the ink-collecting cylinder and the axis of rotation of the intaglio printing cylinder forms in the working position an obtuse angle of 120° with respect to a plane containing the axis of rotation of the impression cylinder and the axis of rotation of the intaglio printing cylinder.

47. The intaglio printing press as defined in claim 46, further comprising a wiping system for wiping the inked surface of the intaglio printing cylinder, wherein the wiping system comprises a wiping roller assembly contacting the surface of the intaglio printing cylinder, and wherein a plane containing the axis of rotation of the wiping roller assembly and the axis of rotation of the intaglio printing cylinder forms an obtuse angle of 120° with respect to the plane containing the axis of rotation of the impression cylinder and the axis of rotation of the intaglio printing cylinder.

48. The intaglio printing press as defined in claim 46, wherein the axis of rotation of the ink-collecting cylinder lies below a horizontal plane containing the axis of rotation of the intaglio printing cylinder.

49. The intaglio printing press as defined in claim 48, wherein the plane containing the axis of rotation of the ink-collecting cylinder and the axis of rotation of the intaglio printing cylinder forms in the working position an acute angle with respect to the horizontal plane.

50. The intaglio printing press as defined in claim 49, wherein the acute angle is lower or equal to 30°.

51. The intaglio printing press as defined in claim 50, wherein the acute angle is comprised between 10° and 25°.

52. The intaglio printing press as defined in claim 42, wherein the ink-collecting cylinder has the same diameter as the intaglio printing cylinder.

53. The intaglio printing press as defined in claim 42, wherein the impression cylinder has the same diameter as the intaglio printing cylinder.

54. The intaglio printing press as defined in claim 42, wherein the ink-collecting cylinder is a three-segment ink-collecting cylinder and wherein the inking system comprises at least four inking devices distributed about a portion of the circumference of the ink-collecting cylinder.

55. The intaglio printing press as defined in claim 42, wherein the intaglio printing press further comprises a second mobile carriage supporting at least part of the at least one inking device, which second mobile carriage is adapted to move with respect to the first mobile carriage between a working position where the second mobile carriage contacts the first mobile carriage and a retracted position where the second mobile carriage is retracted away from the first mobile carriage.

56. The intaglio printing press as defined in claim 42, wherein the at least one inking device comprises an inking unit and a colour-selector cylinder which is inked by the inking unit and contacts a portion of the circumference of the ink-collecting cylinder, and wherein the first mobile carriage also supports the colour-selector cylinder of the at least one inking device.

* * * * *